US006446711B1

(12) United States Patent
DeGroot et al.

(10) Patent No.: US 6,446,711 B1
(45) Date of Patent: Sep. 10, 2002

(54) SIDE PIECE FOR HEAT EXCHANGERS

(75) Inventors: Robert J. DeGroot, Cudahy; Michael Devine, Kenosha, both of WI (US)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 09/748,922

(22) Filed: Dec. 27, 2000

(51) Int. Cl.[7] ..... F28D 1/00; F28D 1/02; F28F 7/00

(52) U.S. Cl. ..... 165/149; 165/153; 165/82

(58) Field of Search ..... 165/149, 134.1, 165/906, 153, 67, 81

(56) References Cited

U.S. PATENT DOCUMENTS 3,246,691 A * 4/1966 LA Porte et al. ..... 165/149
4,367,793 A * 1/1983 MacIntosh ..... 165/149
4,569,390 A * 2/1986 Knowlton et al. ..... 165/149
4,678,026 A 7/1987 Lenz et al.
4,998,580 A 3/1991 Guntly et al.
5,062,478 A 11/1991 Potier et al.
5,257,454 A * 11/1993 Young et al. ..... 165/81
5,366,008 A 11/1994 Kadle et al.
5,505,253 A 4/1996 Heraud
5,667,004 A * 9/1997 Kroetsch ..... 165/149
5,685,364 A 11/1997 Harris
5,740,772 A 4/1998 Bluma
5,816,321 A 10/1998 Wijkstrom
5,996,684 A 12/1999 Clifton et al.
6,059,019 A 5/2000 Brost et al.

* cited by examiner

*Primary Examiner*—Henry Bennett
*Assistant Examiner*—Tho V Duong
(74) *Attorney, Agent, or Firm*—Wood, Phillips, VanSanten, Clark & Mortimer

(57) ABSTRACT

Difficulties in obtaining consistent bonds of high quality between side pieces and tubular headers (10), (12) in heat exchangers are avoided in a side piece (42) that extends between the headers (10), (12) and which has circular recesses (48) at each end (44), (46). The recesses (48) define resilient fingers (56), (58) which may separate to receive the ends of the headers (10), (12) and frictionally grasp the same, eliminating the need for fixturing at this location and assuring a strong consistent gripping of the headers (10), (12), by the end piece (42) to assure consistent bonds of high quality.

20 Claims, 2 Drawing Sheets

SIDE PIECE FOR HEAT EXCHANGERS

FIELD OF THE INVENTION

This invention relates to heat exchangers, and more particularly, to side pieces for use with heat exchangers having tubular headers.

BACKGROUND OF THE INVENTION

Many heat exchangers manufactured today in which air or another gas is the cooling fluid or the fluid to be heated employ side pieces. Side pieces flank the sides of a heat exchanger and typically extend between the headers on opposite ends thereof. Tubes extending between the headers are spaced from one another and disposed between the side pieces and serpentine fins are located between adjacent ones of the tubes as well as the end most tubes and the side pieces.

The side pieces provide a measure of rigidity to the assembly of the headers, tubes and fins, particularly during whatever process is employed to bond these components together, whether soldering, brazing, welding or a combination of two or more of the above methods. They serve to allow an assembled, but unbonded core to be placed in a fixture wherein the bonding operation can take place.

Conventionally, the side pieces may be attached to the headers as by tabs that extend through an opening in a header plate or into the end of a tubular header. These side piece designs typically require fixturing that includes the capability of holding the side piece against the header during the bonding operation in addition to whatever fixturing is required to maintain the entire unassembled core in the proper configuration for bonding.

Even with such fixturing, bonding consistency and quality between the side pieces and the headers varies substantially, thereby affecting the rejection rate of heat exchangers after the bonding process. The present invention is directed to overcoming one or more of the above problems.

SUMMARY OF THE INVENTION

It is the principal object of the invention to provide a new and improved side piece for a heat exchanger. It is also an object of the invention to provide a heat exchanger having a new and improved side piece. It is an object of the invention to provide a side piece that may be bonded to a header with improved consistency and which results in a high quality bond. It is also an object of the invention to provide a side piece that can be assembled to a header prior to bonding without employing the fixturing heretofore required at this interface of the components.

An exemplary body of the invention achieves the foregoing objects in a heat exchanger having opposed, spaced, parallel tubular headers. Aligned, facing tube slots are located in the headers and elongated, flattened tubes that are spaced from one another extend between the headers and have opposite ends sealingly received in corresponding ones of the slots. Side pieces extend between the headers at corresponding ends thereof and are spaced from the tubes. Serpentine fins are disposed between the tubes and between the tubes and the side pieces and bonded thereto. The invention contemplates the improvement wherein each of the side pieces includes an elongated base terminating in two relatively stiff, spaced fingers. The space between the fingers is such as to partially surround the majority of the periphery of the corresponding header end and frictionally grasp the same. The capability of surrounding a majority of the periphery of the header end and frictionally grasping the same eliminates the need for fixturing at this location and improves the consistency and quality of the bonded joint therebetween.

In one embodiment of the invention the fingers are defined by concave recesses at each end of the base which open to the respective end of the base. Each recess has a shape conforming to the cross-sectional shape of the end of the corresponding header and is narrower at its opening to the end of the base than at a point between the opening and a remote part of the recess.

In a preferred embodiment, the base is bone-shaped.

In one embodiment, the cross-sectional shape of the headers is generally circular and the recesses have a wall with an angular extent of more than 180°.

In a highly preferred embodiment, each recess has a bottom opposite the opening and a slot is located in the base having one end opening to the recess and an opposite end in the base remote from the recess. The slot facilitates resiliency in the fingers.

Preferably, the opposite end of the slot terminates in an enlarged opening having a curved, stress relieving periphery. Preferably, the periphery of the enlarged opening is generally circular to provide stress relief.

One embodiment contemplates that the base have flanges extending along each side thereof and along its length. The flanges are directed towards a side of the base remote from the tubes.

In one embodiment, the base is wider about the recesses than at points between the recesses and the flanges have a lesser height adjacent the recesses than at the points between the recesses. This allows the side piece to be formed from a strip of material having a uniform width.

In a preferred embodiment, the recesses or fingers have diverging cam surfaces at the recess openings, allowing the fingers of the side piece to be cammed onto the headers.

Other objects and advantages will become apparent from the following specification taken in connection with the accompanying drawings.

DESCRIPTION OF THE PRIOR ART AND OF THE PREFERRED EMBODIMENT

Figure 1:
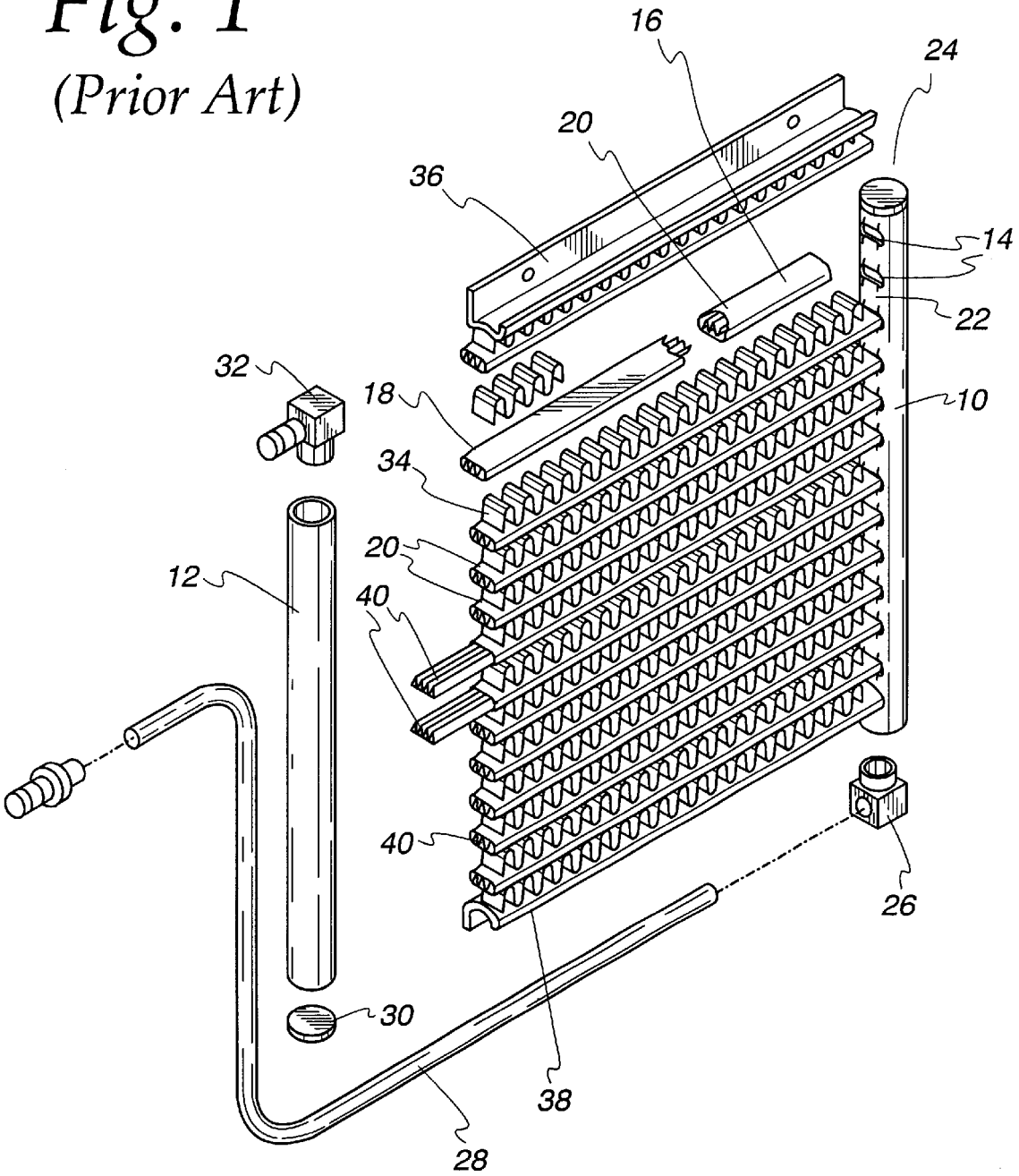
Fig. 1 (Prior Art)
FIG. 1 is an exploded, perspective view of a typical prior art heat exchanger with which the invention may be used.

An exemplary type of heat exchanger with which the invention is adapted to be used is illustrated in FIG. 1 in the form of a so-called parallel flow condenser such as is disclosed in U.S. Pat. No. 4,998,580 issued Mar. 12, 1981 to Guntly et al., and assigned to the Assignee of the instant application. The entire disclosure of such patent is herein incorporated by reference. It is to be understood, however, that the invention is not limited to use with condensers but may be utilized in other forms of heat exchangers having tubular headers as, for example, oil coolers, radiators, evaporators and the like.

The heat exchanger includes opposed, spaced, generally parallel, elongated headers 10 and 12. Typically, but not always, the headers 10 and 12 are made up from generally cylindrical tubing. In some instances, however, two pieces of concave strip are fitted together to form a tube-like structure and it is contemplated that the headers 10 and 12 may be made in that way as well. Moreover, the headers need not be cylindrical but may, in some instances, be polygonal.

On their facing sides, the headers 10 and 12 are provided with a series of generally parallel slots or openings 14 which are aligned with one another for receipt of the corresponding ends 16 and 18 of flattened or oval heat exchanger tubes 20. In some instances, in the areas shown at 22, each of the headers 10 and 12 is provided with a somewhat spherical dome to improve resistance to pressure when the heat exchanger is intended for high pressure applications as in a condenser or an evaporator. Such spherical domes are known from commonly assigned U.S. Pat. No. 4,615,385 to Saperstein et al., the entire disclosure of which is herein incorporated by reference.

The header 10 has one end closed by a cap 24 brazed or welded thereto. Brazed or welded to the opposite end is a fitting 26 to which a tube 28 may be connected.

The lower end of the header 12 is closed by a welded or brazed cap 30 similar to the cap 24 while its upper end is provided with a welded or brazed in place fitting 24. Depending upon the orientation of the heat exchanger, one of the fittings 26 and 32 may serve as an inlet while the other may serve as an outlet.

A plurality of the tubes 20 extend between the headers 10 and 12 and are in fluid communication therewith. The tubes 20 are geometrically in parallel with each other and hydraulically in parallel as well. However, it is to be noted that the tubes themselves need not be straight and may even be in the form of flattened "S" or the like to define partially serpentine tubes. In some cases, baffles may be employed in the headers 10, 12 to provide a multipass heat exchanger. In any event, disposed between adjacent ones of the tubes 20 (or between runs of a single tube, if of a serpentine configuration) are serpentine fins 34 which are highly preferred. However, in some instances, plate fins could be used if desired.

Upper and lower end pieces 36 and 38 extend between and are bonded by any suitable means to the headers 10 and 12 to provide rigidity to the system and to aid in fixturing of the heat exchanger during a bonding process such as soldering, welding, or more preferably, brazing.

In the prior art embodiment illustrated in FIG. 1, each of the tubes 20 is a flattened or oval tube and within its interior includes an undulating or sinusoidally spaced spacer 40 which is bonded to the side walls as is well known. However, extruded tubes may be used as the tubes 20 if desired.

As alluded to previously, and though not shown in FIG. 1, typically tabs are located on the ends of the side pieces 36 and 38 and are either located in slots (not shown) extending through the ends of the headers 10, 12 or folded into the ends of the tubes making up the headers 10, 12. Fixturing is required to hold such elements in place during the brazing operation to assure that the proper bond is created. However, as noted previously, even with such fixturing, the bonding is inconsistent and, with undesirable frequency, of low quality.

Figure 2:
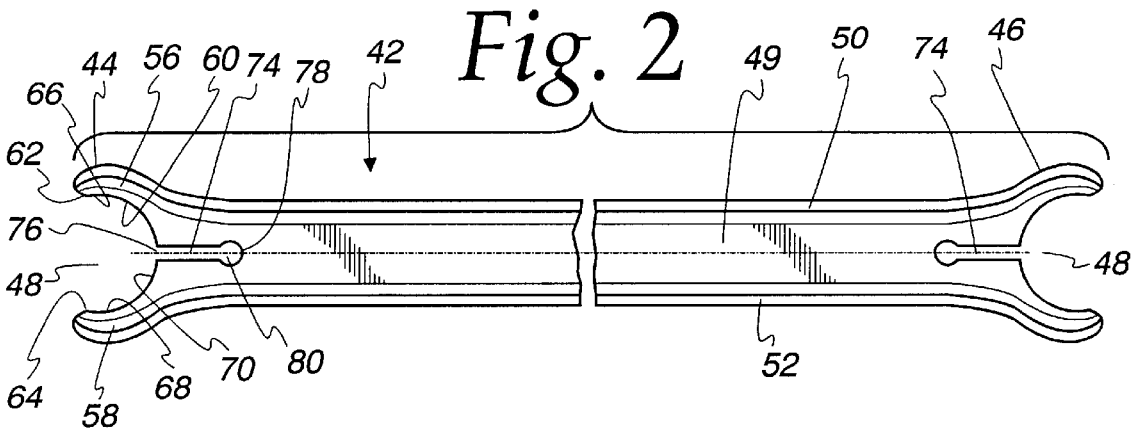
FIG. 2 is a plan view of an exemplary embodiment of a side piece made according to the invention.

Turning now to FIGS. 2–5 inclusive, a side piece made according to the invention and which may be used for either one or both of the side pieces 36, 38 is illustrated. The side piece is generally designated 42 and as illustrated in FIG. 2 is approximately bone-shaped, having enlarged ends 44, 46 with concave recesses 48 in each.

The side piece 42 is made up of an elongated, flat metal base 49, formed of material such as aluminum when the heat exchanger is a brazed heat exchanger. The same is relatively narrow intermediate its ends 44, 46 and has upstanding flanges 50, 52 extending along on both sides of the base 49. As can be readily seen in FIG. 3, the height of the flanges 50, 52 is greater intermediate the ends 44, 46 than at the ends 44, 46. The height of the flange gradually tapers downwardly in a region 54 as the ends 44, 46 are approached. Because the side piece 42 is wider at its ends 44, 46 than at its center, the use of the tapering flange 50, 52 allows formation of the end piece out of a strip of uniform width, not withstanding the difference in width of the final product. The flanges 50, 52 provide resistance to bending of the base 49 and are intended to extend away from the tubes 20.

As the recesses 48 on each end 44, 46 are identical, only one will be described. The recesses 48 open outwardly, that is, in a direction remote from the center of the base 49 and effectively define two fingers 56, and 58 which are spaced from one another by the recess 48. The fingers 56 and 58 are relatively stiff, although resilient, stiffness being a result of the presence of the flanges 50, 52 and/or the thickness of the base 49. This allows the fingers 56, 58 to separate but to resiliently return to their original positions. Consequently, each end 44, 46 of a side piece 42 may be snap fit onto a corresponding end of one of the headers 10, 12. To this end, the space between the fingers 56, 58, i.e., the recess 48, is such as to partially surround the majority of the periphery of the corresponding end of the header as well as to frictionally grasp the same. Thus, where cylindrical headers 10, 12 are used, the interior periphery 60 of each recess 48 is circular and of a diameter no greater than the outside diameter of the header end. Moreover, the angular extent of the peripheral surface 60 must be greater than 180° to prevent the header end from falling out of the recess 40. Thus, the spacing between points 62 and 64 is less than the spacing between points 66 and 68 meaning that each recess 48 is narrower at the opening thereof than at a point intermediate the bottom 70 of the recess 48 and the opening of the recess 48. Typically, for circular tubes, the angular distance between the points 62, 64 will be on the order of 210°. However, other angular spacings may be used so long as they exceed 180° and the dimensioning of the recess 48 is such as to cause good frictional gripping of the header end.

An elongated, relatively narrow slot 74 is located in the base 49 and has one end 76 opening to the bottom 70 of the recess 48. The opposite end 78 terminates in an enlarged, stress relieving opening 80 which is an opening having a periphery of a continuous curve. Typically, the periphery of the opening 80 will be circular. This dissipates stress in the base 49 at that location when the fingers 56, 58 flex during the installation process.

It is also to be observed that each opening, at its outermost end, and past the points 62, 64 terminates in outwardly diverging surfaces 84 on each of the fingers which cam surfaces. The surfaces 84, upon encountering the cylindrical surface of the end of a header, tend to cam the fingers 56, 58 apart to allow the same to slide onto an end of one of the headers 10, 12. Alternatively, however, the end pieces 42 may be installed simply by aligning the ends of the headers 10, 12, with respective ones of the openings 48 and effecting relative movement between the end piece 48 and the headers 10, 12 in the direction of the elongation of the headers 10, 12.

In a highly preferred embodiment, as mentioned previously, the end piece 42 will be made of aluminum so as to be brazed to headers 10, 12 and fins 34, also of aluminum.

Figure 3:
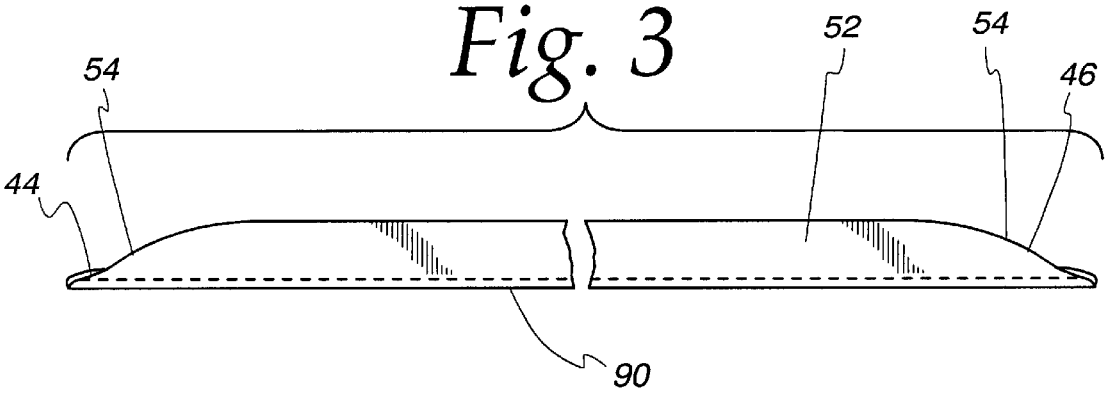
FIG. 3 is a side elevation of the side piece.
Figure 4:
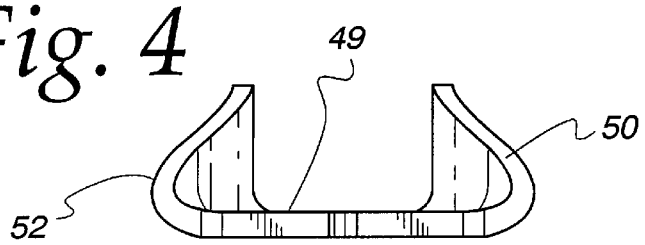
FIG. 4 is an end elevation of the side piece.
Figure 5:
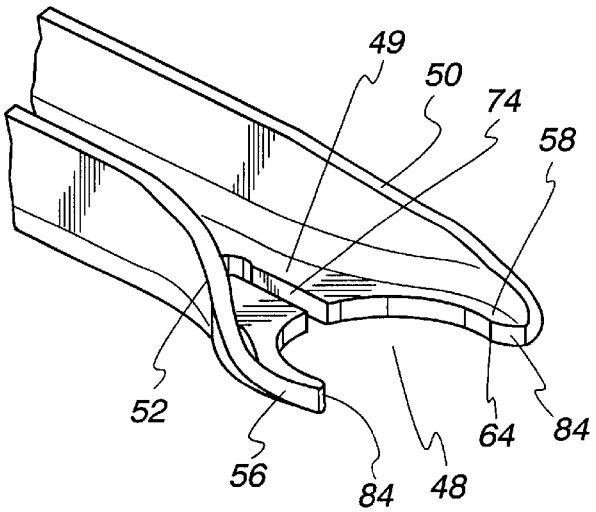
FIG. 5 is an enlarged, fragmentary perspective view of one end of the side piece.

To this end, the lowermost side of the base 49 is viewed in FIG. 3, shown at 90, is conventionally provided with a cladding of braze alloy. The braze alloy shown at 90 will not only bond to the ends of the headers 10, 12 during a brazing process, but will bond to the crests of an adjacent serpentine fin 34 at the same time. In the usual case, the opposite side 92 of the base 49 need not be braze clad although if it is to serve as a mounting point for fixtures or the like, it may be clad as well.

We claim:

1. In a heat exchanger having opposed, spaced, parallel tubular headers having opposite ends, aligned facing tube slots in said headers, elongated, flattened tubes spaced from one another and extending between said headers and having opposite ends sealingly received in aligned facing ones of said slots, side pieces extending between said headers at the ends thereof and spaced from said tubes, and serpentine fins between said tubes, and said tubes and said side pieces, and bonded thereto, the improvement wherein at least one said side piece includes an elongated, generally flat base having opposed ends with a concave recess in the base just inside each end thereof and having an opening to a respective end, each recess having a shape conforming to and being no greater in size than a cross sectional shape of the end of the corresponding header and being narrower at said opening than at a point between said opening and a remote part of said recess.

2. The heat exchanger of claim 1 wherein each said base is generally bone shaped.

3. The heat exchanger of claim 1 wherein said cross sectional shape is generally circular and each said recess has a wall with an angular extent of more than 180°.

4. In a heat exchanger having opposed, spaced, parallel tubular headers having opposite ends, aligned facing tube slots in said headers, elongated, flattened tubes spaced from one another and extending between said headers and having opposite ends sealingly received in aligned facing ones of said slots, side pieces extending between the headers at the ends thereof and spaced from said tubes, and serpentine fins between said tubes, and said tubes and said side pieces, and bonded thereto, the improvement wherein at least one said side piece includes an elongated, generally flat face having opposed ends with a concave recess at each said opposed end thereof and having an opening to a respective opposed end, each recess having a shape conforming to a cross sectional shape of the end of a corresponding header and being narrower at said opening that at a point between said opening and a remote part of said recess, each said recess having a bottom opposite said opening, and a slot in said base having one end opening to said recess and an opposite end in said base and remote from said recess.

5. The heat exchanger of claim 4 wherein said opposite end terminates in an enlarged opening having a curved, stress relieving periphery.

6. The heat exchanger of claim 5 wherein said enlarged opening periphery is generally circular.

7. The heat exchanger of claim 4 wherein side flanges flank said base along its length and extend to a side of said base remote from said tubes.

8. The heat exchanger of claim 7 wherein said base is wider about said recesses than at points between said recesses and said flanges have a lesser height adjacent said recesses than at said points between said recesses.

9. The heat exchanger of claim 1 wherein said recesses have diverging cam surfaces at said openings.

10. In a heat exchanger having opposed, spaced, parallel tubular headers having opposite ends, aligned facing tube slots in said headers, elongated, flattened tubes spaced from one another and extending between said headers and having opposite ends sealingly received in aligned ones of said slots, side pieces extending between said headers at the ends thereof and spaced from said tubes, and serpentine fins between said tubes, and said tubes and said side pieces, and bonded thereto, the improvement wherein at least one said side piece includes an elongated base having a length terminating in two relatively stiff, spaced fingers, a space between said fingers being configured such as to partially surround a majority of a periphery of a header end and frictionally grasp the header end; the fingers having free ends and opposite ends merging into a remainder of said base with spaces between the fingers being at a location intermediate said free ends and said finger opposite ends and spaced from both said free ends and said finger opposite ends.

11. The heat exchanger of claim 10 wherein said fingers merge into said base at locations between said headers, and stress relieving openings in said base at said locations, said stress relieving openings having peripheries configured as closed curves.

12. The heat exchanger of claim 11 wherein said peripheries are circular.

13. The heat exchanger of claim 10 wherein said free ends have facing diverging cam surfaces.

14. The heat exchanger of claim 10 wherein side flanges flank said base, including said fingers, along its length and extend to a side of said base remote from said tubes.

15. The heat exchanger of claim 14 wherein each said base is wider about said fingers than at points intermediate the ends of the base and said flanges have a lesser height adjacent said spaces than at said intermediate points.

16. In a heat exchanger having opposed, spaced, parallel tubular headers having opposite ends, aligned facing tube slots in said headers, elongated, flattened tubes spaced from one another and extending between said headers and having tube opposite ends sealingly received in aligned ones of said slots, side pieces extending between said headers at the ends thereof and spaced from said tubes, and serpentine fins between said tubes, and said tubes and said side pieces, and bonded thereto, the improvement wherein at least one said side piece includes an elongated base having a length terminating in two relatively stiff, spaced fingers, a space between said fingers being such as to partially surround a majority of a periphery of the corresponding header end and frictionally grasp the header end, said fingers merging into said base at locations between said headers;

generally circular stress relieving openings in said base at said locations and located between said fingers thereat;

diverging, facing cam surfaces on ends of said fingers; and side flanges on sides of said base extending along the length thereof, said base being wider about said fingers than at points intermediate the ends of said base, and said flanges having a lesser height about said fingers than at said intermediate points.

17. In a heat exchanger having opposed, spaced, parallel headers having opposite ends and aligned, facing tube slots in said headers, elongated, flattened tubes spaced from one another and each having ends received in aligned ones of said tube slots, side pieces extending between said ends of said opposed headers, and serpentine fins between said tubes and said tubes and said side pieces, the improvement wherein each said side piece includes an elongated, generally flat base having opposed header receiving ends with a concave recess in said flat base just inside each end thereof terminating in an opening to the adjacent header receiving end, each recess having a shape corresponding to a cross sectional shape of an end of said opposed headers and being no greater in size than said cross sectional shape and being narrower at said opening than said cross sectional shape, and side flanges on said flat base extending from end to end thereof between said openings.

18. The heat exchanger of claim 17 wherein said side flanges diminish in height about said parts of said flat base that extend about said recesses.

19. In a heat exchanger having opposed, spaced, parallel headers having opposite ends and aligned, facing tube slots in said headers, elongated, flattened tubes spaced from one another and each having ends received in aligned ones of said tube slots, side pieces extending between said ends of said opposed headers, and serpentine fins between said tubes and said tubes and said side pieces, the improvement wherein each said side piece includes an elongated, generally flat base having opposed header receiving ends with a concave recess in said flat base just inside each end thereof terminating in an opening to the adjacent header receiving end, each recess having a shape corresponding to a cross sectional shape of an end of said opposed headers and being no greater in size than said cross sectional shape and being narrower at said opening than said cross sectional shape, and said recesses further including inwardly directed slots extending into said flat base away from the end thereof at which the recess is located.

20. The heat exchanger of claim 19 wherein each slot, oppositely of said end of said flat base in which the recess is located, terminate in an enlarged opening in said flat base and having a curved periphery to provide stress relief.

* * * * *